US011756478B2

(12) United States Patent
Li

(10) Patent No.: US 11,756,478 B2
(45) Date of Patent: Sep. 12, 2023

(54) DRIVING CIRCUIT, DISPLAY PANEL, AND PANEL

(71) Applicant: TCL CHINA STAR OPTOELECTRONICS TECHNOLOGY CO., LTD., Guangdong (CN)

(72) Inventor: Haoran Li, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 189 days.

(21) Appl. No.: 17/417,793

(22) PCT Filed: May 24, 2021

(86) PCT No.: PCT/CN2021/095368
§ 371 (c)(1),
(2) Date: Jun. 24, 2021

(87) PCT Pub. No.: WO2022/236866
PCT Pub. Date: Nov. 17, 2022

(65) Prior Publication Data

US 2022/0366833 A1 Nov. 17, 2022

(30) Foreign Application Priority Data

May 11, 2021 (CN) ..... 202110512239.7

(51) Int. Cl.
*G09G 3/32* (2016.01)
*G09G 3/34* (2006.01)

(52) U.S. Cl.
CPC ..... *G09G 3/32* (2013.01); *G09G 3/342* (2013.01); *G09G 2300/0819* (2013.01); *G09G 2320/0223* (2013.01); *G09G 2330/021* (2013.01)

(58) Field of Classification Search
CPC .. G09G 3/32; G09G 3/342; G09G 2300/0819; G09G 2320/0223;
(Continued)

(56) References Cited

U.S. PATENT DOCUMENTS

2010/0253707 A1* 10/2010 Miyake ..... G09G 3/3233 345/82
2012/0313923 A1* 12/2012 Minami ..... G09G 3/3233 345/212
(Continued)

FOREIGN PATENT DOCUMENTS

CN 102157113 A 8/2011
CN 103927968 A 7/2014
(Continued)

*Primary Examiner* — Andrew Sasinowski
(74) *Attorney, Agent, or Firm* — Mark M. Friedman

(57) ABSTRACT

A driving circuit, a display panel, and a panel are provided. The driving circuit includes a substrate and signal lines and a plurality of load components disposed on the substrate. The plurality of load components are distributed along a first direction. Each of the load components is connected to the signal lines. The signal lines include at least two signal input terminals. Signals are loaded to signal lines through the at least two signal input terminals.

15 Claims, 7 Drawing Sheets

(58) Field of Classification Search
CPC ..... G09G 2330/021; G09G 2300/06; G09G 2310/0272
See application file for complete search history.

(56) References Cited

U.S. PATENT DOCUMENTS

| | | | | |
|---|---|---|---|---|
| 2015/0310800 | A1* | 10/2015 | Lu | G09G 3/3208 345/82 |
| 2018/0247593 | A1 | 8/2018 | Ni et al. | |
| 2020/0118988 | A1* | 4/2020 | Yueh | H01L 25/167 |

FOREIGN PATENT DOCUMENTS

| | | | |
|---|---|---|---|
| CN | 104409046 | A | 3/2015 |
| CN | 205782610 | U | 12/2016 |
| CN | 108922493 | A | 11/2018 |
| CN | 110249430 | A | 9/2019 |
| CN | 110599955 | A | 12/2019 |
| CN | 110649042 | A | 1/2020 |
| CN | 111243496 | A | 6/2020 |
| CN | 111445860 | A | 7/2020 |
| CN | 111999936 | A | 11/2020 |
| CN | 112331676 | A | 2/2021 |
| CN | 112767880 | A | 5/2021 |

* cited by examiner

DRIVING CIRCUIT, DISPLAY PANEL, AND PANEL

BACKGROUND OF INVENTION

Field of Invention

The present application relates to the field of display technology and particularly to a driving circuit, a display panel, and a panel.

Description of Prior Art

Regarding mini light-emitting diode (mini-LED) panels and micro light-emitting diode (micro-LED) panels with glass substrates acting as carriers, a thickness of metal layers deposited on the glass substrates is limited, and it is difficult to reach a thickness level of metal layers on conventional printed circuit board (PCB) substrates. In large-size LED panels, impedance values of key signal lines with large spans, such as ground signal lines, chip driving signal lines, and LED driving signal lines, are relatively large, causing obvious line loss (internal resistance (IR) drop).

In signal lines of current large-size LED panels, only one signal input terminal is disposed. In order to ensure that a farthest LED away from the signal input terminal can obtain a normal working voltage, voltage signals loaded to the signal input terminal needs to take into account the voltage loss caused by the line loss on the signal lines to allow the voltage signal actually loaded to the signal input terminal to be much larger than an initial set value. Therefore, greater power loss is induced, and devices close to the signal input are even damaged.

SUMMARY OF INVENTION

Embodiments of the present application provides a driving circuit, a display panel, and a panel to solve a technical problem that a farthest load component away from a signal input terminal cannot work normally due to insufficient voltage incurred by line loss of signal lines in large-size panels. The embodiments of the present application provides the driving circuit, the display panel, and the panel. When signals are inputted in one terminal of large-size panels, voltage signals actually loaded to a signal input terminal being much larger than an initial setting value causing more power consumption, or devices near the signal input terminal being damaged due to the actually-loaded voltage being too large is prevented.

One embodiment of the present application provides a driving circuit, including a substrate and signal lines and a plurality of load components disposed on the substrate. The plurality of load components are distributed along a first direction. Each of the load components is connected to the signal lines. The signal lines include at least two signal input terminals. Signals are loaded to signal lines through the at least two signal input terminals.

Optionally, in some specific embodiments of the present application, the load components include a plurality of load elements coupled in series and constant current driving chips configured to drive the load elements, one end of the load elements is connected to the signal lines, and another end of the load elements is connected to the constant current driving chips.

Optionally, in some specific embodiments of the present application, the substrate further includes a first side and a second side opposite to the first side, the first direction extends from the first side to the second side, one of signal input terminals is disposed close to the first side, and another one of signal input terminals is disposed close to the second side.

One embodiment of the present application further provides a display panel, including the aforesaid driving circuit, and the load components include light-emitting elements.

One embodiment of the present application further provides a panel, including a substrate and signal lines and a plurality of light-emitting components disposed on the substrate. The plurality of light-emitting components are distributed along a first direction. Each of the light-emitting components is connected to the signal lines. The signal lines include at least two signal input terminals. Signals are loaded to signal lines through the at least two signal input terminals.

Optionally, in some specific embodiments of the present application, each of the light-emitting components includes a plurality of light bars and constant current driving chips configured to drive the light bars, the light bars include a plurality of light-emitting elements coupled in series, one end of the light bars is connected to the signal lines, another end of the light bars is connected to the constant current driving chips, the signal lines include light-emitting driving signal lines, the light-emitting driving signal lines include at least two light-emitting driving signal input terminals, and light-emitting driving signals are loaded to the light-emitting driving signal lines through the at least two light-emitting driving signal input terminals.

Optionally, in some specific embodiments of the present application, the signal lines further include chip driving signal lines, the plurality of constant current driving chips in the plurality of light-emitting components are connected to the chip driving signal lines, the chip driving signal lines include at least two chip driving signal input terminals, and chip driving signals are loaded to the chip driving signal lines through the at least two chip driving signal input terminals.

Optionally, in some specific embodiments of the present application, the signal lines further include grounding signal lines, the plurality of constant current driving chips in the plurality of light-emitting components are connected to the grounding signal lines, the grounding signal lines include at least two grounding signal input terminals, and grounding signals are loaded to the grounding signal lines through the at least two grounding signal input terminals.

Optionally, in some specific embodiments of the present application, the panel further includes a first side and a second side opposite to the first side, the first direction extends from the first side to the second side, the light-emitting driving signal input terminals include a first light-emitting driving signal input terminal and a second light-emitting driving signal input terminal, the first light-emitting driving signal input terminal is disposed close to the first side, and the second light-emitting driving signal input terminal is disposed close to the second side, and the light-emitting driving signal input terminals further include a third light-emitting driving signal input terminal, and the third light-emitting driving signal input terminal is located between the first light-emitting driving signal input terminal and the second light-emitting driving signal input terminal in the first direction.

Optionally, in some specific embodiments of the present application, the panel further includes a first side and a second side opposite to the first side, the first direction extends from the first side to the second side, one of signal input terminals is disposed close to the first side, and another one of signal input terminals is disposed close to the second side.

Optionally, in some specific embodiments of the present application, each of the light-emitting components includes a plurality of light bars and constant current driving chips configured to drive the light bars, the signal lines include chip driving signal lines, each of constant current driving chips is electrically connected to the chip driving signal lines, the chip driving signal lines include at least two chip driving signal input terminals, and chip driving signals are loaded to the chip driving signal lines through the at least two chip driving signal input terminals, and at least two of the light-emitting components are disposed between the two adjacent chip driving signal input terminals in the first direction.

Optionally, in some specific embodiments of the present application, each of the light-emitting components includes a plurality of light bars and constant current driving chips configured to drive the light bars, the signal lines are grounding signal lines, each of constant current driving chips is electrically connected to the grounding signal lines, the grounding signal lines include at least two grounding signal input terminals, and grounding signals are loaded to the grounding signal lines through the at least two grounding signal input terminals, and at least two of the light-emitting components are disposed between the two adjacent grounding signal input terminals in the first direction.

Optionally, in some specific embodiments of the present application, each of the light-emitting components includes a first light bar, a second light bar, and constant current driving chips configured to drive the first light bar and/or the second light bar, the signal lines include a first light-emitting driving signal line and a second light-emitting driving signal line, the first light bar includes a plurality of light-emitting elements coupled in series, one end of the first light bar is connected to the first light-emitting driving signal line, another end of the first light bar is connected to the constant current driving chips, the second light bar include a plurality of light-emitting elements coupled in series, one end of the second light bar is connected to the second light-emitting driving signal line, another end of the second light bar is connected to the constant current driving chips, the signals include a first light-emitting driving signal and a second light-emitting driving signal, the first light-emitting driving signal line includes at least two first light-emitting driving signal input terminals, the first light-emitting driving signal is loaded to the first light-emitting driving signal line through the at least two first light-emitting driving signal input terminals, the second light-emitting driving signal line includes at least two second light-emitting driving signal input terminals, and the second light-emitting driving signal is loaded to the second light-emitting driving signal line through the at least two second light-emitting driving signal input terminals.

Optionally, in some specific embodiments of the present application, the panel further includes signal connection terminals configured to input the signals and a first connection line and a second connection line connected to the signal connection terminals, the first connection line is connected to one of the signal input terminals, and the second connection line is connected to another one of the signal input terminals.

Optionally, in some specific embodiments of the present application, the signal lines extend along the first direction, the at least two signal input terminals are distributed uniformly along the first direction, at least two of the light-emitting components are disposed between the two adjacent signal input terminals in the first direction.

Optionally, in some specific embodiments of the present application, the panel is a light-emitting diode (LED) light plate, and the light-emitting components are LED components.

Optionally, in some specific embodiments of the present application, each of the light-emitting components includes four light bars and four constant current driving chips configured to drive the four light bars, the light bars include a plurality of light-emitting elements coupled in series, one end of the light bars is connected to the signal lines, another end of the light bars is connected to the constant current driving chips, the signal lines include light-emitting driving signal lines, the light-emitting driving signal lines include a plurality of light-emitting driving signal input terminals, and light-emitting driving signals are loaded to the light-emitting driving signal lines through the plurality of light-emitting driving signal input terminals.

Optionally, in some specific embodiments of the present application, the panel further includes a first side and a second side opposite to the first side, the first direction extends from the first side to the second side, the light-emitting driving signal input terminals include a first light-emitting driving signal input terminal and a second light-emitting driving signal input terminal, the first light-emitting driving signal input terminal is disposed close to the first side, and the second light-emitting driving signal input terminal is disposed close to the second side, and the light-emitting elements are LED elements.

Optionally, in some specific embodiments of the present application, the light-emitting driving signal input terminals further include a third light-emitting driving signal input terminal, and the third light-emitting driving signal input terminal is located between the first light-emitting driving signal input terminal and the second light-emitting driving signal input terminal in the first direction.

Beneficial effect of the present application: the signal lines include the at least two signal input terminals, and the signals are loaded to signal lines through the plurality of signal input terminals, which improves consistency of overall voltages of signal lines, thereby remedying a problem of insufficient voltage of the farthest load component away from the signal input terminal due to line loss; meanwhile, the signals are loaded to signal lines through the plurality of signal input terminals, which can prevent increasing the line loss voltage to the initial setting value to act as the actually-loaded voltage value from increasing the power loss on the signal line when the signals are loaded to one terminal, and the load devices close to the signal input terminal being damaged due to the actually-loaded voltage being too large can be prevented.

DESCRIPTION OF DRAWINGS

To more clearly illustrate the technical solutions of the embodiments of the present application, the required accompanying figures for description of embodiments is described in brief as follow. Obviously, the accompanying figures described below are only part of the embodiments of the present application, from which figures those skilled in the art can derive further figures without making any inventive efforts.

DETAILED DESCRIPTION OF EMBODIMENTS

The technical solutions in the embodiments of the present application are clearly and completely described in the following with reference to the accompanying drawings in the embodiments of the present application. Obviously, the described embodiments are only part of the embodiments of the present application, and are not all embodiments of the present application. All other embodiments obtained by those skilled in the art based on the embodiments of the present application without creative efforts are within the scope of the present application.

The present application provides a panel, including a substrate and signal lines and a plurality of light-emitting components disposed on the substrate. The plurality of light-emitting components are distributed along a first direction. Each of the light-emitting components is connected to the signal lines. The signal lines include the at least two signal input terminals. Signals are loaded to the signal lines through the at least two signal input terminals. In the present application, by loading the signals to signal lines through the plurality of signal input terminals, consistency of overall voltages of signal lines is improved, thereby remedying the problem of insufficient voltage of the farthest light emitting diodes (LEDs) away from the signal input terminal due to line loss; meanwhile, it can prevent increasing the line loss voltage to the initial setting value to act as the actually-loaded voltage value from increasing the power loss on the signal line when the signals are loaded to one terminal, and the devices close to the signal input terminal being damaged due to the actually-loaded voltage being too large can be prevented.

Figure 1:
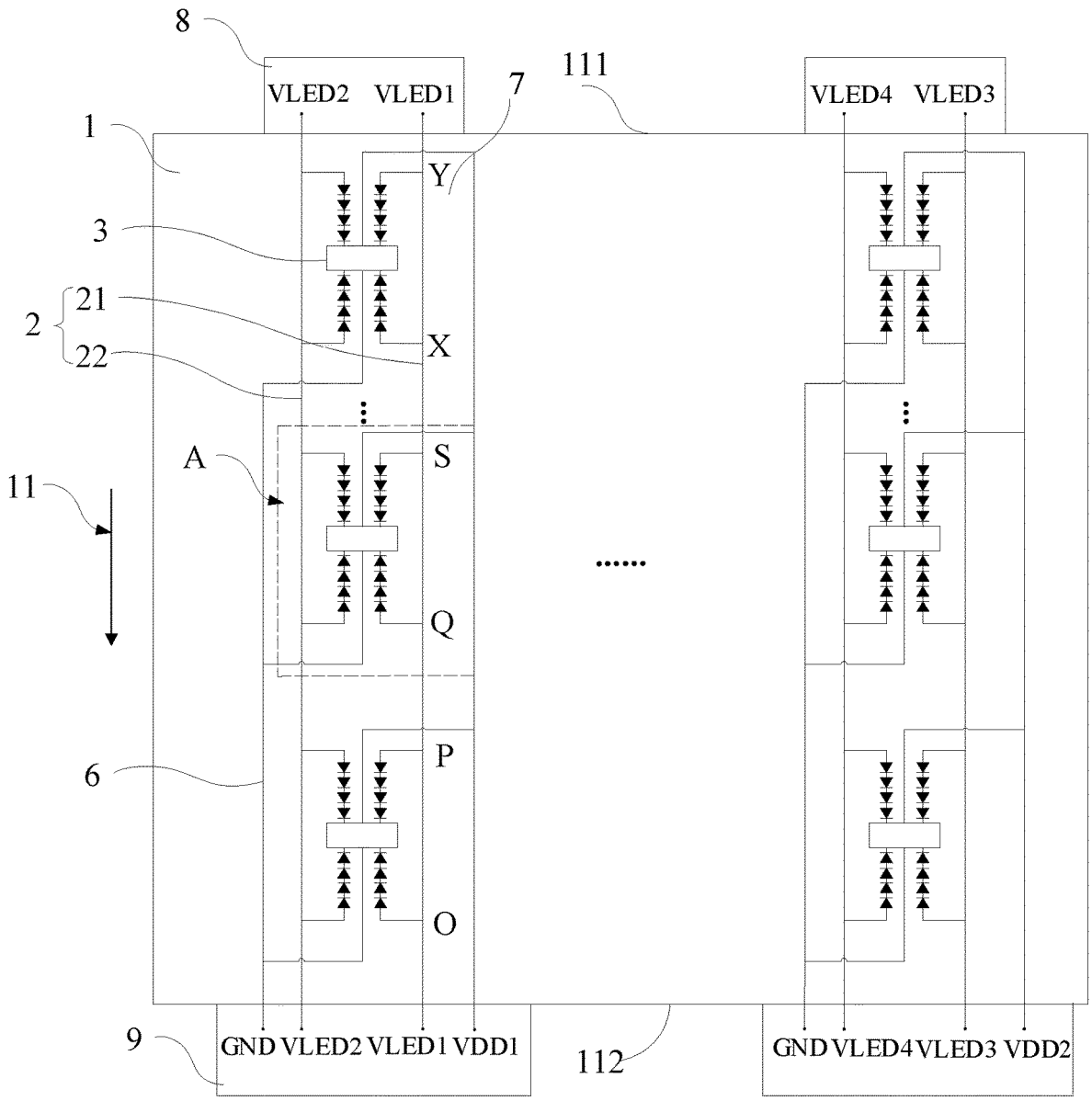
FIG. 1 is a schematic diagram of a first embodiment of a panel provided by the present application.
Figure 2:
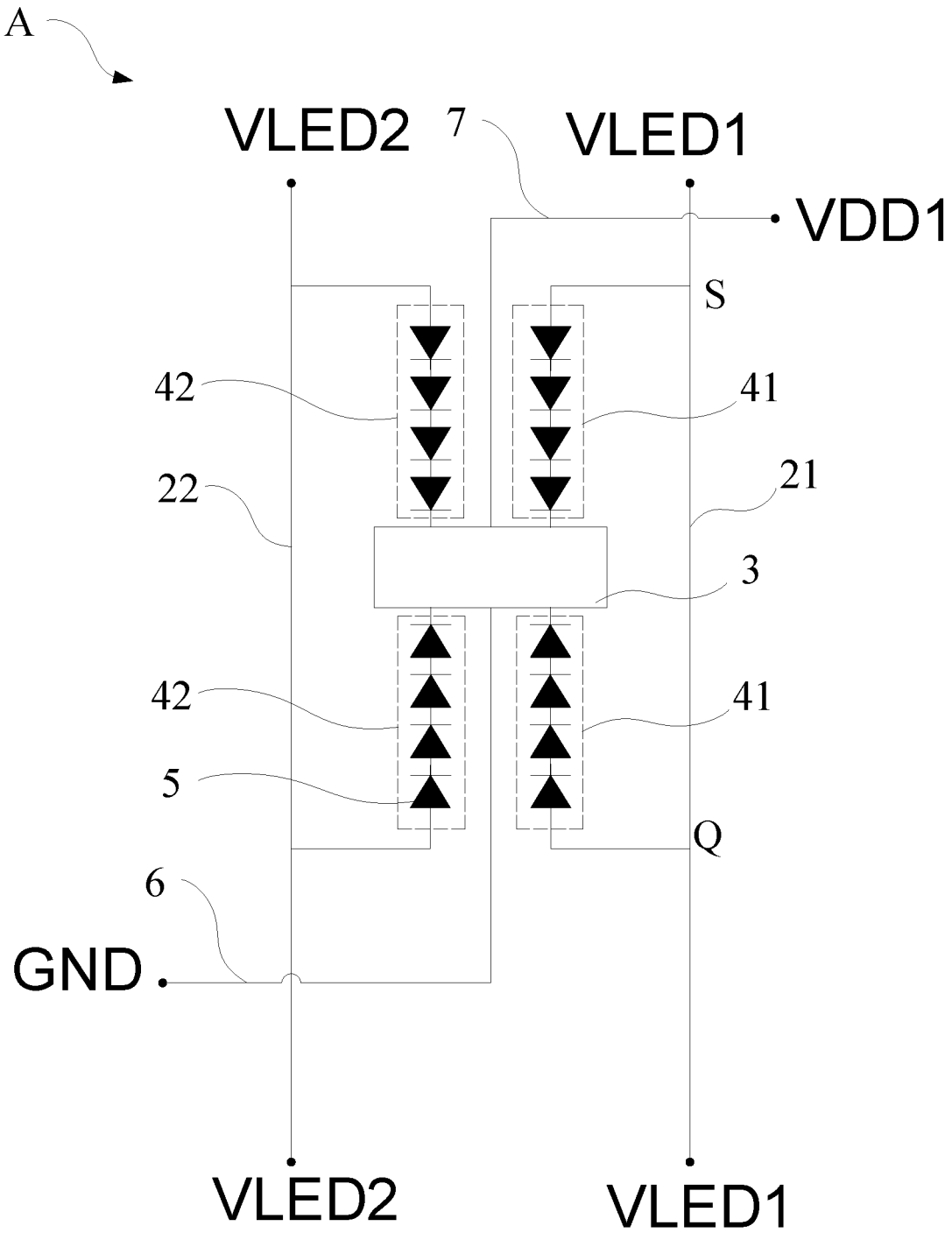
FIG. 2 is a schematic diagram of an enlargement of position Ain FIG. 1.

A first embodiment provided by the present application is illustrated as FIG. 1 and FIG. 2. This embodiment provides a panel including a substrate 1. The panel further includes a light-emitting driving signal line 2, a plurality of light-emitting components A, a grounding signal line 6, and a chip driving signal line 7 disposed on the substrate 1.

The substrate 1 is a glass substrate. The substrate 1 is rectangular. The substrate 1 includes a first side 111 and a second side 112 opposite to the first side 111. A first direction extends from the first side 111 to the second side 112.

The light-emitting driving signal lines 2 include a first light-emitting driving signal line 21 and a second light-emitting driving signal line 22. The first light-emitting driving signal line 21 and the second light-emitting driving signal line 22 extend along the first direction 11.

The first light-emitting driving signal line 21 extends along the first direction 11. The first light-emitting driving signal line 21 includes two first light-emitting driving signal input terminals VLED1. The two first light-emitting driving signal input terminals VLED1 are located on two ends of the first light-emitting driving signal line 21. Wherein, one of the first light-emitting driving signal input terminals VLED1 is disposed close to the first side 111, and the another one of the first light-emitting driving signal input terminals VLED1 is disposed close to the second side 112. Specifically, one of the first light-emitting driving signal input terminals VLED1 is disposed on a side of the light-emitting components A adjacent to the first side 111 and close to the first side 111, and another one of the first light-emitting driving signal input terminals VLED1 is disposed on a side of the light-emitting components A adjacent to the second side 112 and close to the second side 112. The first LED driving signal is loaded from two ends to the first light-emitting driving signal line 21 through the two first light-emitting driving signal input terminals VLED1.

The second light-emitting driving signal line 22 extends along the first direction 11. The second light-emitting driving signal line 22 includes two second light-emitting driving signal input terminals VLED2. The two second light-emitting driving signal input terminals VLED2 are located on two ends of the second light-emitting driving signal line 22. Wherein, one of the second light-emitting driving signal input terminals VLED2 is disposed close to the first side 111, and the another one of the second light-emitting driving signal input terminals VLED2 is disposed close to the second side 112. Specifically, one of the second light-emitting driving signal input terminals VLED2 is disposed on a side of the light-emitting components A adjacent to the first side 111 and close to the first side 111, and another one of the second light-emitting driving signal input terminals VLED2 is disposed on a side of the light-emitting components A adjacent to the second side 112 close to the second side 112. The second LED driving signal is loaded from two ends of the second first light-emitting driving signal input terminal VLED2 to the second light-emitting driving signal line 22.

The plurality of light-emitting components A are uniformly distributed along a first direction 11. Each of the light-emitting components A is connected to the first light-emitting driving signal line 21 and the second light-emitting driving signal line 22. With reference to FIG. 2, each of the light-emitting components A includes a first light bar 41, a second light bar 42, and constant current driving chips 3 configured to drive the first light bar 41 and the second light bar 42. In this embodiment, the light-emitting components A are LED light-emitting components. The light bars are LED light bars.

The first light bar 41 includes a plurality of light-emitting diodes 5 coupled in series. One end of the first light bar 41 is connected to the first light-emitting driving signal line 21. An anode of the first light bar 41 is electrically connected to the first light-emitting driving signal line 21. Another end of the first light bar 41 is connected to the constant current driving chips 3. A cathode of the first light bar 41 is electrically connected to a constant current output terminal (not shown in the figure) of the constant current driving chips 3.

The second light bar 42 includes a plurality of light-emitting diodes 5 coupled in series. One end of the second light bar 42 is connected to the second light-emitting driving signal line 22. An anode of the second light bar 42 is electrically connected to the second light-emitting driving signal line 22. Another end of the second light bar 42 is connected to the constant current driving chips 3. A cathode of the second light bar 42 is electrically connected to a constant current output terminal (not shown in the figure) of the constant current driving chips 3.

The constant current driving chips 3 have a grounding terminal, a power source input terminal, and a constant current output terminal. The grounding terminal is electrically connected to the grounding line 6 through a conducting wire. The power source input terminal is electrically connected to the chip driving signal line 7 through a conducting wire. In the plurality of constant current driving chips 3 in the plurality of light-emitting components A uniformly distributed along the first direction, the grounding terminal of each constant current driving chip 3 is connected to the grounding signal line 6, and the power source input terminal of each constant current driving chip 3 is connected to the chip driving signal line 7.

The grounding signal line 6 extends along the first direction 11. The grounding signal line 6 has one grounding signal input terminal GND. The grounding signal input terminal GND is disposed close to the second side 112. A grounding signal is loaded to the grounding signal line 6 from one end of the grounding signal line 6 through the grounding signal input terminal GND.

The chip driving signal line 7 extends along the first direction 11. The chip driving signal line 7 has one chip driving signal input terminal VDD1. The chip driving signal input terminal VDD1 is disposed close to the second side 112. A chip driving signal is loaded to the chip driving signal line 7 from one end of the chip driving signal line 7 through the chip driving signal input terminal VDD1.

In the present application, a plurality of signal input terminals are disposed on the signal lines extending along the first direction 11. The plurality of signal input terminals are distributed along the first direction 11. By loading the signals to signal lines through the plurality of signal input terminals, consistency of overall voltages of signal lines is improved, thereby remedying the problem of insufficient voltage of the farthest light emitting diodes (LEDs) away from the signal input terminal due to line loss. Meanwhile, it can prevent increasing the line loss voltage to the initial setting value to act as the actually-loaded voltage value from increasing the power loss on the signal line when the signals are loaded to one terminal, and the devices close to the signal input terminal being damaged due to the actually-loaded voltage being too large can be prevented.

Specifically, with reference to FIG. 1 and FIG. 2. If a driving voltage of each light emitting diode 5 is 6V, then a normal lighting voltage of the first light bar 41 is 24V. The first LED driving signal loaded to the anode of the first light bar 41 should be greater than or equal to 24V. Connection points of the first light bar 41 and the first light-emitting driving signal line 21 in the light-emitting components adjacent to the second side 112 are O and P. Connection points of the first light bar 41 and the first light-emitting driving signal line 21 in the adjacent light-emitting components A are Q and S. Connection points of the first light bar 41 and the first light-emitting driving signal line 21 in the light-emitting components A farthest from the second side 112 are X and Y.

In prior art, the first LED driving signal is only inputted from one end of the first light-emitting driving signal line 21 close to the second side 112. If a number of the light-emitting components A in a same column is 10, then the constant current output terminal of the constant current driving chip 3 outputs a constant current of 10 mA, and a line resistance of the first light-emitting driving signal line 21 located between connection points of two adjacent first light bars 41 and the first light-emitting driving signal line 21 is 1Ω. A voltage drop between the point O and the point P is: Vdrop=1 Ω*10 mA=10 mV. A voltage drop between the point O and the point Q is: Vdrop=1 Ω*(20 mA+10 mA)=30 mV. A voltage drop between the point O and the point S is: Vdrop=10*(30 mA+20 mA+10 mA)=60 mV. A voltage drop between the point O and a point X is: Vdrop=10*(180 mA+170 mA+ . . . +30 mA+20 mA+10 mA)=1710 mV. A voltage drop between the point O and a point Y is: Vdrop=10*(190 mA+180 mA+ . . . +30 mA+20 mA+10 mA)=1.9V. A voltage drop between the light-emitting driving signal input terminal VLED1 and the point Y is: Vdrop=1 Ω*(200 mA+190 mA+180 mA+ . . . +30 mA+20 mA+10 mA)=2.1V.

If the grounding signal line 6 has a resistance similar to a resistance of the first light-emitting driving signal line 21, a voltage drop of 2.1V is also generated on the grounding signal line 6. Therefore, considering the line loss, the voltage value that actually needs to be loaded to the first light-emitting driving signal input terminal VLED1 is: V=24V+2.1V+2.1V=28.2V. Required increment of power loss of an entire column of the light-emitting components A is: P=4.2V*200 mA=0.84 W. Correspondingly, the voltage loaded to the point O is 28.2V-1 Ω*200*2 mA, i.e., 27.8V, which is much larger than 24V needed to be endured by the first light bar 41 during normal light emission.

However, by adopting the method of this embodiment, the first LED driving signals are simultaneously loaded to the first light-emitting driving signal line 21 through the two first light-emitting driving signal input terminals VLED1 at two ends of the first light-emitting driving signal line 21, and at this time, a maximum voltage drop on the first light-emitting driving signal line 21 is: Vm=1 Ω*(100 mA+90 mA+ . . . +30 mA+20 mA+10 mA)=0.55V. The voltage value that actually needs to be loaded to the first light-emitting driving signal input terminal VLED1 is: V=24V+2.1V+0.55V=26.65V. Required increment of power consumption of an entire column of the light-emitting components A is: P=2.65V*200 mA=0.53 W. Correspondingly, the voltage loaded to the point O is 26.65V-1 Ω*200 mA*2, i.e., 26.25V, which lowers the actually-loaded voltage value on the first light bar 41 close to the first light-emitting driving signal input terminal VLED1 at a certain extent, and reduces the power loss of the light-emitting components A.

Similarly, in this embodiment, by simultaneously loading the second light-emitting driving signal to the second light-emitting driving signal line 22 through the two second light-emitting driving signal input terminals VLED2 at two ends of the second light-emitting driving signal line 22 at the same time, the actually-loaded voltage value to the second light bar 42 close to the second light-emitting driving signal input terminal VLED2 can also be reduced, and the power loss of light-emitting modules A is further reduced.

The panel further includes a first flexible circuit board 8 and a second flexible circuit board 9 connected to the substrate 1. The first flexible circuit board 8 is connected to the first side 111. The second flexible circuit board 9 is connected to the second side 112.

A plurality of conductive wires configured to transmit the first light-emitting driving signal and configured to transmit the second light-emitting driving signal are disposed on the first flexible circuit board 8. By electrically connecting the first flexible circuit board 8 to the substrate 1 in a press-fit manner, the first light-emitting driving signal is transmitted to the first light-emitting driving signal input terminal VLED1 close to the first side 111 in the first light-emitting driving signal line 21, and the second light-emitting driving signal is transmitted to the second light-emitting driving signal input terminal VLED2 close to the first side 111 in the second light-emitting driving signal line 22. In this embodiment, the first flexible circuit board 8 is configured to solve technical problems of complex wiring around the panel and high cost due to complex jumper wire processes. The first flexible circuit board 8 acts as a jumper circuit to realize long-distance jumper transmission of signals.

A driving chip and other peripheral circuit are disposed on the second flexible circuit board 9. The grounding signal, the first light-emitting driving signal, the second light-emitting driving signal, and the chip driving signal are generated on the second flexible circuit board 9. A plurality of signal transmission terminals are disposed on the second flexible circuit board 9. The signal connection terminals on second flexible circuit board 9 are electrically connected to signal connection terminals of the substrate 1 in a press-fit manner. By electrically connecting the second flexible circuit board 9 to the substrate 1 in a press-fit manner, the aforesaid signals generated by the second flexible circuit board 9 are inputted to corresponding signal lines. Specifically, the grounding signal generated on the second flexible circuit board 9 is loaded to the grounding signal line 6 from one end of the grounding signal line 6 through the grounding signal input terminal GND. The chip driving signal generated on the second flexible circuit board 9 is loaded to the chip driving signal line 7 from one end of the chip driving signal line 7 through the chip driving signal input terminal VDD1. The first light-emitting driving signal generated on the second flexible circuit board 9 is loaded from two ends to the first light-emitting driving signal line 21 through the two first light-emitting driving signal input terminals VLED1. The second light-emitting driving signal generated on the second flexible circuit board 9 is loaded from two ends to the second light-emitting driving signal line 22 through the two second light-emitting driving signal input terminals VLED2.

It can be understood that in other specific embodiments of the present application, a driving chip and other peripheral circuits can also be disposed on the first flexible circuit board 8. The first flexible circuit board 8 can also generate a first light-emitting driving signal and a second light-emitting driving signal same as the first light-emitting driving signal and the second light-emitting driving signal generated on the second flexible circuit board. The first light-emitting driving signal generated on the first flexible circuit board 8 and the first light-emitting driving signal generated on the second flexible circuit board 9 are loaded from the first light-emitting driving signal input terminal VLED1 at two ends of the first light-emitting driving signal line 21 to the first light-emitting driving signal line 21. The second light-emitting driving signal generated on the first flexible circuit board 8 and the second light-emitting driving signal generated on the second flexible circuit board 9 are loaded from the second light-emitting driving signal input terminal VLED2 at two ends of the second light-emitting driving signal line 22 to the second light-emitting driving signal line 22.

In this embodiment, the first light-emitting driving signal and the second light-emitting driving signal are same direct-current voltage drive signals. In other embodiment, the first light-emitting driving signal and the second light-emitting driving signal can also be different direct-current voltage drive signals. A voltage value of the first light-emitting driving signal is determined by working voltage values of the first light bar 41, and the voltage loss values of the first light-emitting driving signal line 21 and the grounding signal line 6. A voltage value of the second light-emitting driving signal is determined by working voltage values of the second light bar 42, and the voltage loss values of the second light-emitting driving signal line 22 and the grounding signal line 6.

In this embodiment, the constant current driving chip 3 in each light-emitting component A simultaneously drives four light bars time during normal operation. Specifically, each constant current driving chip 3 simultaneously drives two first light bars 41 and two second light bars 42 during normal operation. It can be understood that in other specific embodiments of the present application, each constant current driving chip 3 can also simultaneously drive two, three, six, or eight light bars during normal operation. A number of light bars specifically connected to the constant current driving chip 3 is limited by a driving ability of the constant current driving chip 3, which is not specifically limited herein.

It can be understood that in this embodiment, the first light-emitting driving signal line 21 can further include the plurality of first light-emitting driving signal input terminals VLED1. The first light-emitting driving signal is loaded to the first light-emitting driving signal line 21 from a plurality of terminals through the plurality of first light-emitting driving signal input terminals VLED1, thereby further improving uniformity of voltage of the first light-emitting driving signal line 21. A number of the first light-emitting driving signal input terminals VLED1 included by the first light-emitting driving signal line 21 is not limited herein. Similarly, the second light-emitting driving signal line 22 can also include a plurality of two second light-emitting driving signal input terminals VLED2. The second light-emitting driving signal is loaded to the second light-emitting driving signal line 22 from a plurality of terminals through the plurality of second light-emitting driving signal input terminals VLED2, thereby further improving uniformity of voltage of the second light-emitting driving signal line 22. A number of the second light-emitting driving signal input terminals VLED2 included by the second light-emitting driving signal line 22 is also not limited herein.

In this embodiment, a plurality of rows of the aforesaid light-emitting components A are disposed on the panel, and a specific number of the rows is not specifically limited herein.

Figure 3:
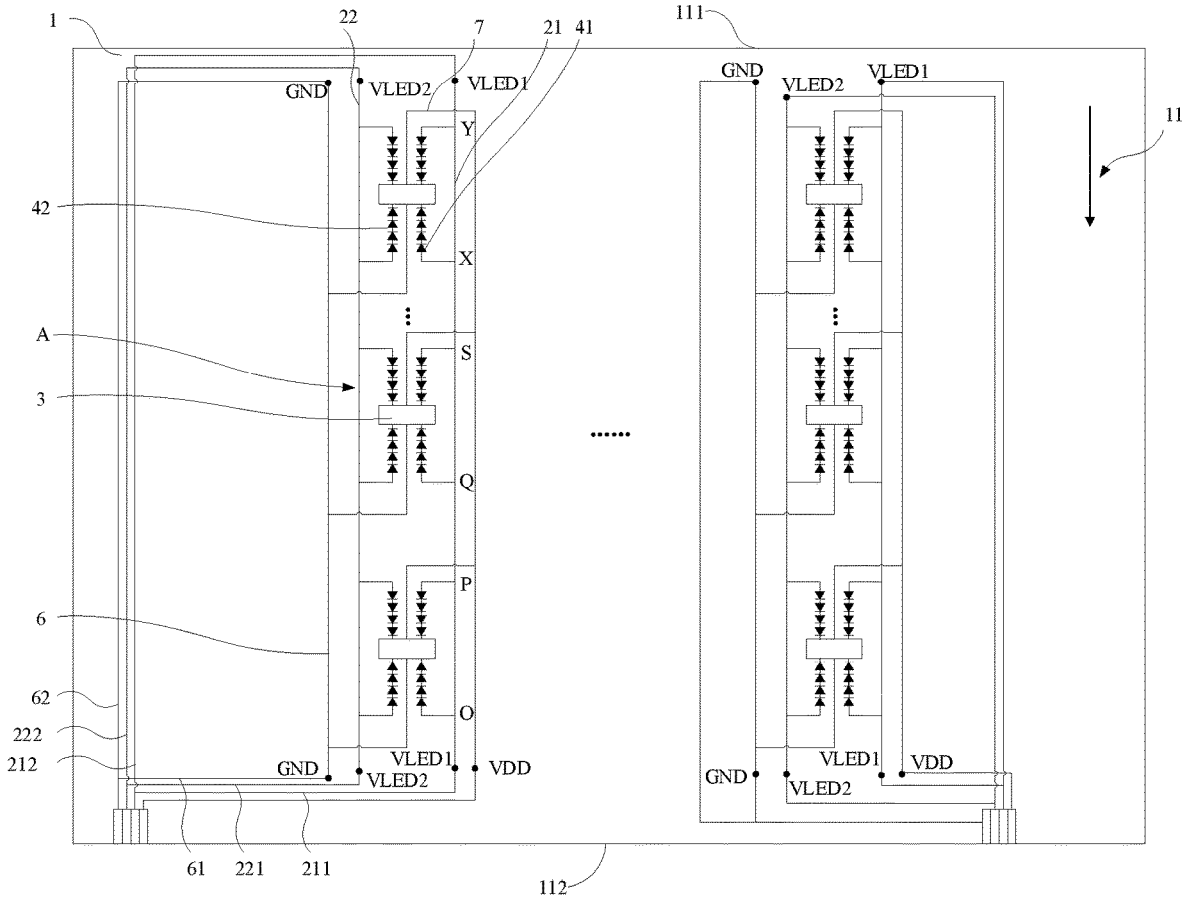
FIG. 3 is a schematic diagram of a second embodiment of the panel provided by the present application.

A second embodiment provided by the present application is illustrated as FIG. 3. One difference between this embodiment and the first embodiment is that the grounding signal line 6 extending along the first direction 11 has two grounding signal input terminals GND. The two grounding signal input terminals GND are located on two ends of the grounding signal line 6. One of the grounding signal input terminal GND is disposed close to the first side 111, and another one of the grounding signal input terminals GND is disposed close to the second side 112. Specifically, one of the grounding signal input terminals GND is disposed on a side of the light-emitting components A adjacent to the first side 111 and close to the first side 111, and another one of the grounding signal input terminals GND is disposed on a side of the light-emitting components A adjacent to the second side 112 and close to the second side 112. A grounding signal is loaded to the grounding signal line 6 from two ends to the grounding signal line 6 through the grounding signal input terminal GND. In the first direction 11, at least two of the light-emitting components A are disposed between the two adjacent grounding signal input terminals GND.

With reference to FIG. 1, in the first embodiment, if the grounding signal is only inputted from one end of the grounding signal line 6 close to the second side 112, and a number of the light-emitting components A in a same column is 10, then the constant current output terminal of the constant current driving chip 3 outputs a constant current of 10 mA, and a line resistance of the first light-emitting driving signal line 21 located between connection points of two adjacent first light bars 41 and the first light-emitting driving signal line 21 is 10.

As described in the first embodiment, a maximum voltage drop Vm of the first light-emitting drive signal line 21 can be reduced to 0.55V through the aforesaid design. Because the grounding signal is only inputted from one end of the grounding signal line 6 in the first embodiment, if the ground signal line 6 has a resistance similar to the resistance of the first light-emitting driving signal line 21, a voltage drop of 2.1V is still generated on the grounding signal line 6. Therefore, considering the line loss, the voltage value that actually needs to be loaded to the first light-emitting driving signal input terminal VLED1 is: V=24V+2.1V+0.55V=26.65V. Required increment of power consumption of an entire column of the light-emitting components A is: P=2.65V*200 mA=0.53 W. Correspondingly, the voltage loaded to the point O is 26.65V-1 Ω*200 mA*2, i.e., 26.25V.

However, adopting the method of this embodiment, the grounding signal is simultaneously loaded to the grounding signal line 6 through the two grounding signal input terminals GND at the two ends of the grounding signal line 6. At this time, a maximum voltage drop Vm1 of the grounding signal line 6 is also reduced to 0.55V. The voltage value that actually needs to be loaded to the first light-emitting driving signal input terminal VLED1 is: V=24V+0.55V+0.55V=25.1V. Required increment of power loss of an entire column of the light-emitting components A is: P=1.1V*200 mA=0.22 W. Correspondingly, the voltage loaded to the point O is 25.1V-1 Ω*200 mA*2, i.e., 24.7V.

In summary, the actually-loaded voltage value to the first light bar 41 close to the first light-emitting driving signal input terminal VLED1 is 24.7V. The voltage value is also the maximum driving voltage value endured by the plurality of first light bars 41 in the column. This voltage value is very close to the voltage of 24V required for the first light bars 41 to normally emit light. Uniformity of the voltage of the first light-emitting driving signal line 21 is significantly improved. Similarly, uniformity of the voltage of the second light-emitting driving signal line 22 is also significantly improved compared to the first embodiment. Furthermore, the increased loss P required for the entire column of the light-emitting components A is reduced to 0.22 W, which is only a quarter of the prior art and significantly reduces the power loss of the panel.

In addition, in this application, the panel further includes signal connection terminals 10 disposed on the substrate 1. The signal connection terminals 10 are configured to input signals generated by external circuits to corresponding signal lines. The panel further includes a first connection line and a second connection line connected to the signal connection terminals 10 on the substrate 1. The first connection line is connected to one of the signal input terminals of the corresponding signal lines. The second connection line is connected to another one of the signal input terminals of the corresponding signal lines. The signal lines extend along the first direction. The second connection line has a part extending along the first direction.

Specifically, in this embodiment, the signal connection terminals 10 include a grounding signal connection terminal, a first light-emitting driving signal connection terminal, a second light-emitting driving signal connection terminal, and a chip driving signal connection terminal.

The panel further includes a first grounding signal connection line 61 and a second grounding signal connection line 62 connected to the grounding signal connection terminals. The first grounding signal connection line 61 is connected to one grounding signal input terminal GND of the grounding signal line 6. The second grounding signal connection line 62 is connected to another grounding signal input terminal GND of the grounding signal line 6. The grounding signal connection line 62 has a part extending along the first direction.

The panel further includes a first light-emitting driving signal connection line 211 and a second light-emitting driving signal connection line 212 connected to the first light-emitting driving signal connection terminals. The first light-emitting driving signal connection line 211 is connected to one first light-emitting driving signal input terminal VLED1 of the first light-emitting driving signal line 21. The second light-emitting driving signal connection line 212 is connected to another first light-emitting driving signal input terminal VLED1 of the first light-emitting driving signal line 21. The first light-emitting driving signal line 21 extends along the first direction. The second light-emitting driving signal connection line 212 has a part extending along the first direction.

The panel further includes a third light-emitting driving signal connection line 221 and a fourth light-emitting driving signal connection line 222 connected to the second light-emitting driving signal connection terminals. The third light-emitting driving signal connection line 221 is connected to one second light-emitting driving signal connection terminal VLED2 of the second light-emitting driving signal line 22. The fourth light-emitting driving signal connection line 222 is connected to another second light-emitting driving signal connection terminal VLED2 of the second light-emitting driving signal line 22. The second light-emitting driving signal line 22 extends along the first direction. The four light-emitting driving signal connection line 222 has a part extending along the first direction.

Figure 4:
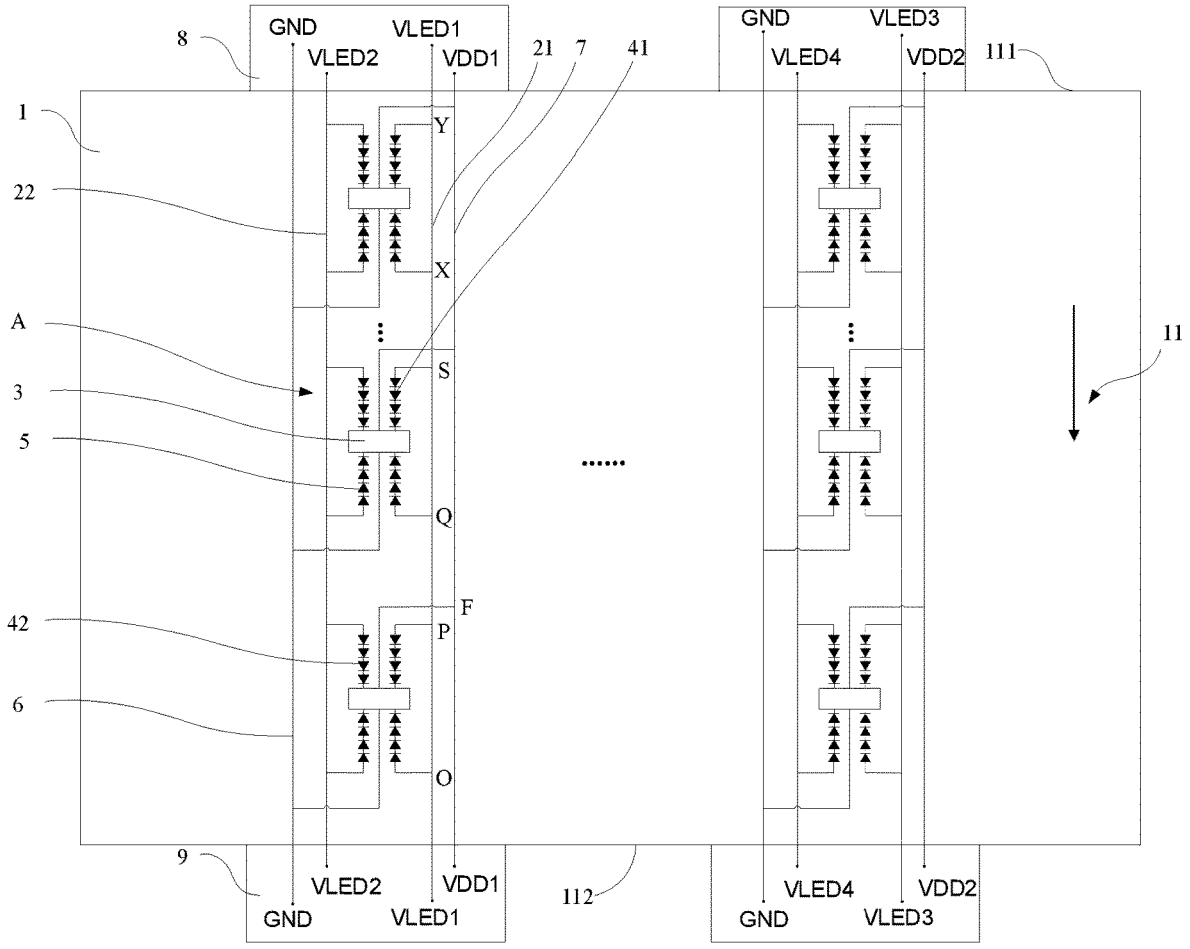
FIG. 4 is a schematic diagram of a third embodiment of the panel provided by the present application.

A third embodiment provided by the present application is illustrated as FIG. 4. One difference between this embodiment and the second embodiment is that the chip driving signal line 7 extending in the first direction 11 has two chip driving signal input terminals VDD1. The two chip driving signal input terminals VDD1 are located on two ends of the chip driving signal lines 7. One of the chip driving signal input terminals VDD1 is disposed close to the first side 111, and the another one of the chip driving signal input terminals VDD1 is disposed close to the second side 112. Specifically, one of the chip driving signal input terminals VDD1 is disposed on a side of the light-emitting components A adjacent to the first side 111 and close to the first side 111, and another one of the chip driving signal input terminals VDD1 is disposed on a side of the light-emitting components A adjacent to the second side 112 and close to the second side 112. The chip driving signal is loaded to the chip driving signal line 7 from two ends through the two chip driving signal input terminals VDD1. In the first direction 11, at least two of the light-emitting components A are disposed between the two adjacent chip driving signal input terminals VDD1.

With reference to FIG. 1, in the first embodiment, if the constant current driving chip is only inputted from one end of the chip driving signal line 7 close to the second side 112, the number of the light-emitting components A in a same column is 10, then the constant current output terminal of the constant current driving chip 3 outputs a constant current of 10 mA, and a line resistance of the first light-emitting driving signal line 21 located between connection points of two adjacent first light bars 41 and the first light-emitting driving signal line 21 is 10. Therefore, the maximum voltage drop Vm of the first light-emitting driving signal line 21 has been reduced to 0.55V. If the grounding signal line 6 has a resistance similar to a resistance of the first light-emitting driving signal line 21, a maximum voltage drop Vm1 of the grounding signal line 6 is 2.1V.

If the chip driving signal line 7 has a resistance similar to a resistance of the first light-emitting driving signal line 21, a voltage drop of 2.1V is also generated on the chip driving signal line 7. Because a normal working voltage of the constant current driving chip 3 is 3.3V, considering the voltage drop on the grounding signal line 6 and the chip driving signal line 7, the driving voltage of the chip actually loaded at point F is 3.3V+2.1V+2.1V, i.e. 7.5V. Regarding the corresponding constant current driving chip 3, this value has exceeded a normal operating voltage range of the constant current driving chip 3, which can cause the constant current driving chip 3 to fail to work or be damaged.

However, adopting the method of this embodiment, the grounding signal is simultaneously loaded to the grounding signal line 6 through the two grounding signal input terminals GND at the two ends of the grounding signal line 6. Meanwhile, the chip driving signals are simultaneously loaded to the chip driving signal line 7 through the two chip driving signal input terminals VDD1 at the two ends of the chip driving signal line 7. At this time, the maximum voltage drop Vm of the first light-emitting driving signal line 21 has been reduced to 0.55V. The maximum voltage drop Vm1 of the grounding signal line 6 is also reduced to 0.55V. A maximum voltage drop Vm2 of the chip driving signal line 7 is also reduced to 0.55V. The voltage value that actually needs to be loaded to the chip driving signal input terminal VDD1 is: V1=3.3V+0.55V+0.55V=4.4V. Required increment of power loss on lines of the chip of an entire column of the light-emitting components A is: P'=1.1V*200 mA=0.22 W. Correspondingly, the chip driving voltage loaded at the point F is 4.4V, which is still within the normal operating voltage range of the constant current driving chip 3, and is unlikely to damage the constant current driving chip 3.

In summary, the actually-loaded voltage value to the first light bar 41 close to the first light-emitting driving signal input terminal VLED1 is 24.7V. The voltage value is also same as the maximum driving voltage value endured by the first light bars 41 in the column. This voltage value is very close to the voltage of 24V required for the first light bars 41 to normally emit light. Uniformity of the voltage of the first light-emitting driving signal line 21 is significantly improved. Similarly, uniformity of the voltage of the second light-emitting driving signal line 22 is also significantly improved compared to the first embodiment. Furthermore, the increased loss P of LED lines required for the entire column of the light-emitting components A is reduced to 0.22 W, which is only a quarter of the prior art and significantly reduces the power loss of the panel.

Furthermore, the actually-loaded voltage value on the constant current driving chip 3 close to the chip driving signal input terminal VDD1 is 4.4V. The voltage value is also the maximum driving voltage value endured by the plurality of constant current driving chips 3 in the column. The voltage value is still within the normal operating voltage range of the constant current driving chip 3. Uniformity of the voltage of the chip driving signal line 7 is significantly improved. Moreover, required increment of the power loss P' of the chip lines of the entire column of the light-emitting components A is reduced to 0.22 W, which further reduces the overall power loss of the panel.

Figure 5:
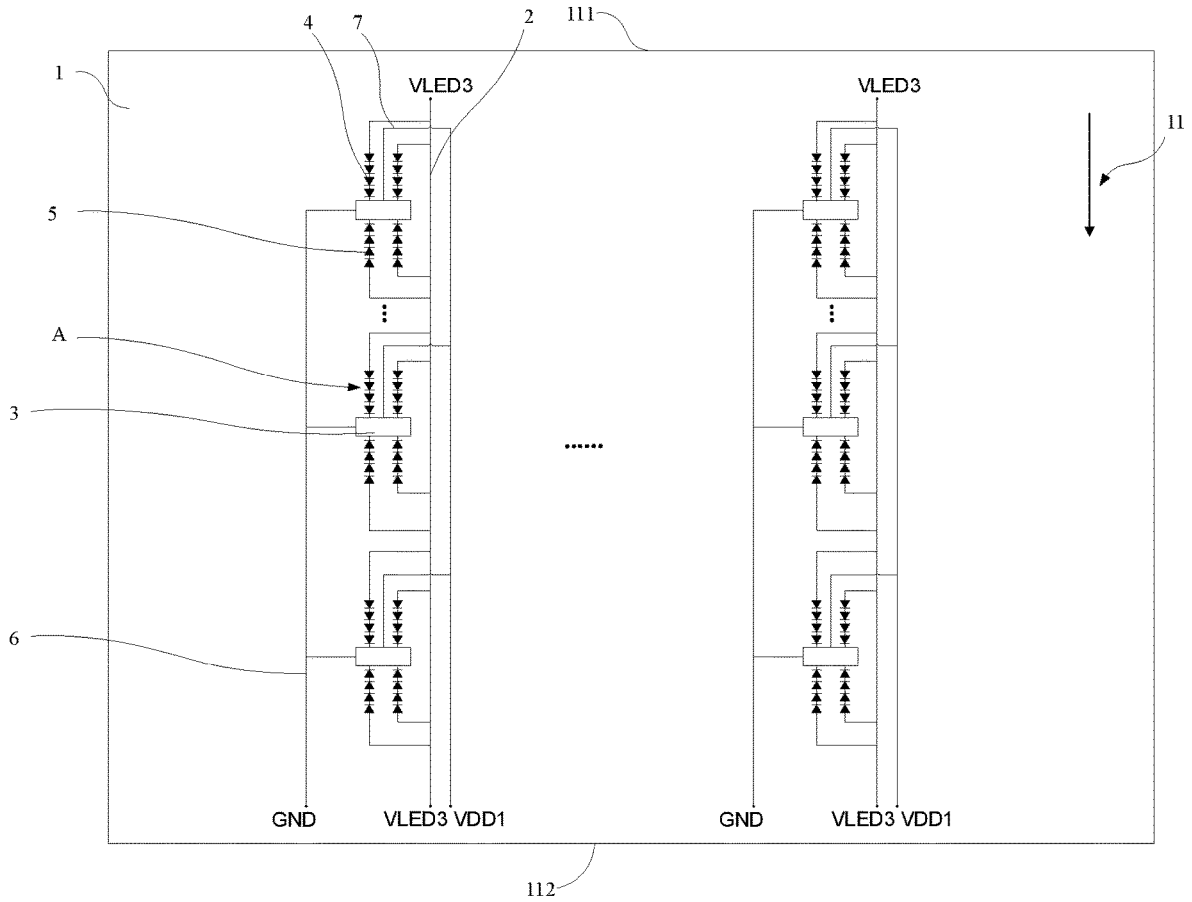
FIG. 5 is a schematic diagram of a fourth embodiment of the panel provided by the present application.

A fourth embodiment provided by the present application is illustrated as FIG. 5. One difference between this embodiment and the first embodiment is that the plurality of light-emitting components A located in the same column are only connected to one light-emitting driving signal line 2. Specifically, each of the light-emitting components A includes four light bars 4 and one constant current driving chip 3 configured to drive the light bars 4. Each of the light bars 4 includes four light-emitting diodes 5 coupled in series. One end of the light bars 4 is connected to the light-emitting driving signal line 2. An anode of the light bars 4 is electrically connected to the light-emitting driving signal line 2. Another end of the light bars 4 is connected to the constant current driving chip 3. A cathode of the light bars 4 is electrically connected to a constant current output terminal (not shown in the figure) of the constant current driving chip 3.

The light-emitting driving signal line 2 includes two third light-emitting driving signal input terminals VLED3. The two third light-emitting driving signal input terminals VLED3 are located on two ends of the light-emitting driving signal line 2. One of the third light-emitting driving signal input terminals VLED3 is disposed close to the first side 111, and the another one of the third light-emitting driving signal input terminals VLED3 is disposed close to the second side 112. Specifically, one of the third light-emitting driving signal input terminals VLED3 is disposed on a side of the light-emitting components A adjacent to the first side 111 and close to the first side 111, and another one of the third light-emitting driving signal input terminals VLED3 is disposed on a side of the light-emitting components A adjacent to the second side 112 and close to the second side 112. The light-emitting driving signal line is loaded from two ends to the light-emitting driving signal line 2 through the two third light-emitting driving signal input terminals VLED3.

By simultaneously loading the light-emitting driving signal to the light-emitting drive signal line 2 through the two third light-emitting driving signal input terminals VLED3 at the two ends of the light-emitting driving signal line 2, uniformity of the voltage of the light-emitting driving signal line 2 is improved, the actually-loaded voltage value to the light bars 4 close to the third light-emitting driving signal input terminals VLED3 is reduced, and the power loss of the light-emitting components A is reduced.

It can be understood that in other specific embodiments of the present application, it is also allowable to use three, four, or a plurality of light-emitting driving signal lines 2 to drive the plurality of light bars 4. A specific number of the light-emitting driving signal lines 2 is not limited herein.

Figure 6:
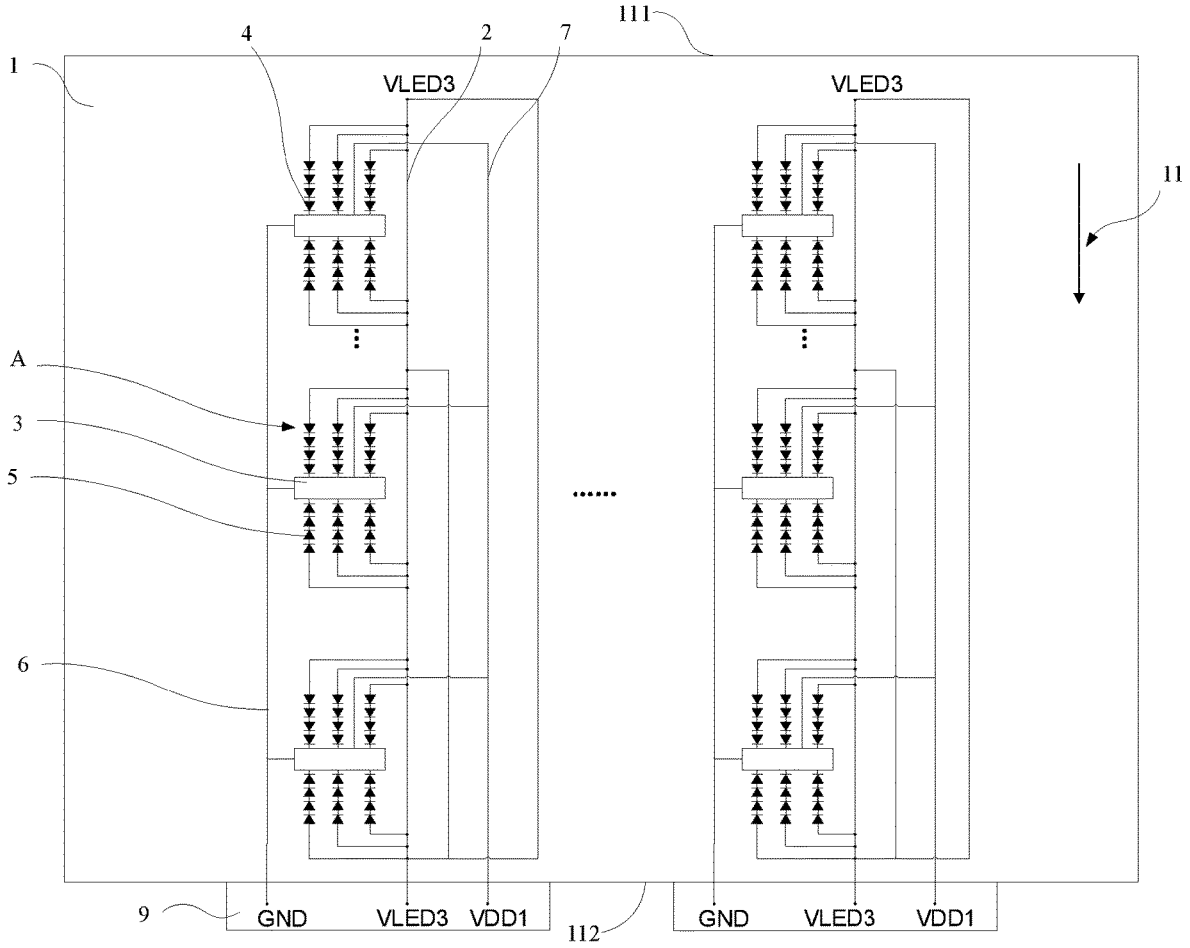
FIG. 6 is a schematic diagram of a fifth embodiment of the panel provided by the present application.

A fifth embodiment provided by the present application is illustrated as FIG. 6. One difference between this embodiment and the fourth embodiment is that the light-emitting driving signal line 2 includes three light-emitting driving signal input terminals VLED3. Wherein, the two third light-emitting driving signal input terminals VLED3 are located on two ends of the light-emitting driving signal line 2, and another third light-emitting driving signal input terminal VLED3 is located between the two third light-emitting driving signal terminals VLED3. Specifically, one of the third light-emitting driving signal input terminals VLED3 is disposed close to the first side 111, another one of the third light-emitting driving signal input terminals VLED3 is disposed close to the second side 112, and yet another one of the third light-emitting driving signal input terminals VLED3 is disposed on a middle position along the first direction 11 between the aforesaid two third light-emitting driving signal input terminals VLED3.

By simultaneously loading the light-emitting driving signals to the light-emitting drive signal line 2 through the three third light-emitting driving signal input terminals VLED3 of the light-emitting driving signal line 2, the uniformity of the voltage of the light-emitting driving signal line 2 is further improved, the actually-loaded voltage value to the light bars 4 close to the third light-emitting driving signal input terminals VLED3 is further reduced, and the power loss of the light-emitting components A is significantly reduced.

One further difference of this embodiment and the fourth embodiment is that each of the light-emitting components A includes six light bars 4 and one constant current driving chip 3 configured to drive the light bars 4. Anodes of the six light bars are connected to one same light-emitting driving signal line 2. Cathodes of the six light bars 4 are electrically connected to a constant current output terminal (not shown in the figure) of the constant current driving chip 3.

It can be understood that in present application, in the signal lines including the light-emitting driving signal line, the grounding signal line 6 and the chip driving signal line 7, the part extending along the first direction 11 can include three, four, five or more signal input terminals. The greater the number of the signal input terminals distributed along the first direction 11 on the signal line is, the more uniform the voltage on the signal line is. The smaller the voltage loss on the signal line is, the closer the driving voltage carried by devices in the light-emitting components A near the signal input terminal to a theoretical operating voltage value is, thereby the device is protected while power consumption is effectively reduced.

In this embodiment, the constant current driving chip 3 in each light-emitting component A simultaneously drives four or six light bars time during normal operation. It can be understood that in other specific embodiments of the present application, each constant current driving chip 3 can also simultaneously drive two, three, five, eight, or more light bars during normal operation. A number of light bars specifically connected to the constant current driving chip 3 is limited by a driving ability of the constant current driving chip 3, which is not specifically limited herein.

In the present application, each of the light bars 4 is composed of four light-emitting diodes 5 coupled in series. It can be understood that in other specific embodiments of the present application, a number of the light-emitting diodes 5 within each light bar 4 is not limited specifically.

It can be understood that the panel provided in the present application is an LED light panel, specifically it can be an LED light panel used for LED display, or it can be an LED light panel used for a backlight source of a backlight module of a display panel.

Figure 7:
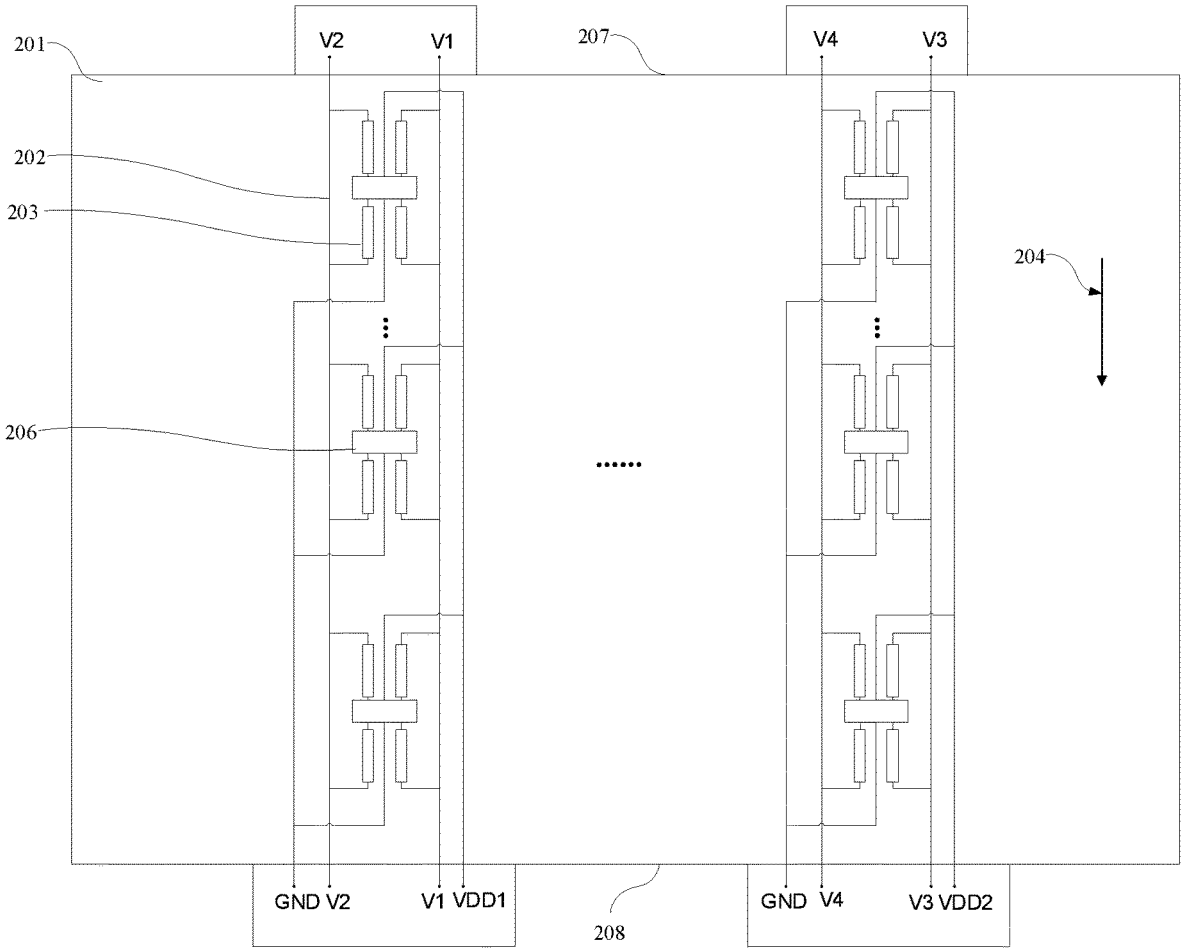
FIG. 7 is a schematic diagram of a driving circuit provided by the present application.

The present application further provides a driving circuit as illustrated in FIG. 7, which includes a substrate 201 and signal lines 202 and a plurality of light-emitting components 203 disposed on the substrate 201. The plurality of load components 203 are distributed along a first direction 204. Each of the load components 203 is connected to the signal lines 202. The signal lines 202 include the at least two signal input terminals (V1, V2, V3, or V4). Signals are loaded to the signal lines 202 through the at least two signal input terminals. Each of the load components 203 includes a plurality of load elements coupled in series and constant current driving chips 206 configured to drive the load elements. One end of the load elements is connected to the signal lines 202. Another end of the load elements is connected to the constant current driving chips 206. The panel further includes a first side 207 and a second side 208 opposite to the first side 207. A first direction 204 extends from the first side 207 to the second side 208. One of the signal input terminals (one of V1, V2, V3, or V4) is disposed close to the first side 207, and another one of the signal input terminals connected to the signal input terminal is disposed close to the second side 208.

The present application further provides a display panel, including the aforesaid driving circuit, and the load components 203 can be light-emitting elements. Specifically, the load component 203 can be LED elements on an LED panel in a backlight assembly of the display panel. In some specific embodiments, the load components 203 can also be pixel units on the display panel. The load components 203 specifically include organic light-emitting pixel units.

In the present application, by loading the signals to signal lines through the plurality of signal input terminals, consistency of overall voltages of signal lines is improved, thereby remedying the problem of insufficient driving voltage of the light bars away from the signal input terminals; meanwhile, the actually-loaded voltage value of the relevant devices can be reduced to prevent the devices close to the signal input terminals from being damaged, and the power loss on the signal lines can be reduced.

The above describes the display panel of the embodiments of the present application in detail. This article uses specific cases for describing the principles and the embodiments of the present application, and the description of the embodiments mentioned above is only for helping to understand the method and the core idea of the present application. Meanwhile, for those skilled in the art, will have various changes in specific embodiments and application scopes according to the idea of the present application. In summary, the content of the specification should not be understood as limit to the present application.

What is claimed is:

1. A panel, comprising a substrate and signal lines and a plurality of light-emitting components disposed on the substrate, wherein the plurality of light-emitting components are distributed along a first direction, each of the light-emitting components is connected to the signal lines, the signal lines comprise at least two signal input terminals, and signals are loaded to the signal lines through the at least two signal input terminals;

wherein each of the light-emitting components comprises a plurality of light bars and constant current driving chips configured to drive the light bars, the light bars comprise a plurality of light-emitting elements coupled in series, one end of the light bars is connected to the signal lines, another end of the light bars is connected to the constant current driving chips, the signal lines comprise light-emitting driving signal lines, the light-emitting driving signal lines comprise at least two light-emitting driving signal input terminals, and light-emitting driving signals are loaded to the light-emitting driving signal lines through the at least two light-emitting driving signal input terminals.

2. The panel as claimed in claim 1, wherein the signal lines further comprise chip driving signal lines, the plurality of constant current driving chips in the plurality of light-emitting components are connected to the chip driving signal lines, the chip driving signal lines comprise at least two chip driving signal input terminals, and chip driving signals are loaded to the chip driving signal lines through the at least two chip driving signal input terminals.

3. The panel as claimed in claim 1, wherein the signal lines further comprise grounding signal lines, the plurality of constant current driving chips in the plurality of light-emitting components are connected to the grounding signal lines, the grounding signal lines comprise at least two grounding signal input terminals, and grounding signals are loaded to the grounding signal lines through the at least two grounding signal input terminals.

4. The panel as claimed in claim 1, wherein the panel further comprises a first side and a second side opposite to the first side, the first direction extends from the first side to the second side, the light-emitting driving signal input terminals comprise a first light-emitting driving signal input terminal and a second light-emitting driving signal input terminal, the first light-emitting driving signal input terminal is disposed close to the first side, and the second light-emitting driving signal input terminal is disposed close to the second side.

5. The panel as claimed in claim 4, wherein the light-emitting driving signal input terminals further comprise a third light-emitting driving signal input terminal, and the third light-emitting driving signal input terminal is located between the first light-emitting driving signal input terminal and the second light-emitting driving signal input terminal in the first direction.

6. The panel as claimed in claim 1, wherein the panel further comprises a first side and a second side opposite to the first side, the first direction extends from the first side to the second side, one of signal input terminals is disposed close to the first side, and another one of signal input terminals is disposed close to the second side.

7. The panel as claimed in claim 1, wherein each of the light-emitting components comprises a first light bar, a second light bar, and constant current driving chips configured to drive the first light bar or the second light bar, the signal lines comprise a first light-emitting driving signal line and a second light-emitting driving signal line, the first light bar comprises a plurality of light-emitting elements coupled in series, one end of the first light bar is connected to the first light-emitting driving signal line, another end of the first light bar is connected to the constant current driving chips, the second light bar comprise a plurality of light-emitting elements coupled in series, one end of the second light bar is connected to the second light-emitting driving signal line, another end of the second light bar is connected to the constant current driving chips, the signals comprise a first light-emitting driving signal and a second light-emitting driving signal, the first light-emitting driving signal line comprises at least two first light-emitting driving signal input terminals, the first light-emitting driving signal is loaded to the first light-emitting driving signal line through the at least two first light-emitting driving signal input terminals, the second light-emitting driving signal line comprises at least two second light-emitting driving signal input terminals, and the second light-emitting driving signal is loaded to the second light-emitting driving signal line through the at least two second light-emitting driving signal input terminals.

8. The panel as claimed in claim 1, wherein the panel further comprises signal connection terminals configured to input the signals and a first connection line and a second connection line connected to the signal connection terminals, the first connection line is connected to one of the signal input terminals, and the second connection line is connected to another one of the signal input terminals.

9. The panel as claimed in claim 1, wherein the signal lines extend along the first direction, the at least two signal input terminals are distributed uniformly along the first direction, at least two of the light-emitting components are disposed between the two adjacent signal input terminals in the first direction.

10. The panel as claimed in claim 1, wherein the panel is a light-emitting diode (LED) light plate, and the light-emitting components are LED components.

11. The panel as claimed in claim 1, wherein each of the light-emitting components comprises four light bars and four constant current driving chips configured to drive the four light bars, the light bars comprise a plurality of light-emitting elements coupled in series, one end of the light bars is connected to the signal lines, another end of the light bars is connected to the constant current driving chips, the signal lines comprise light-emitting driving signal lines, the light-emitting driving signal lines comprise a plurality of light-emitting driving signal input terminals, and light-emitting driving signals are loaded to the light-emitting driving signal lines through the plurality of light-emitting driving signal input terminals.

12. The panel as claimed in claim 11, wherein the panel further comprises a first side and a second side opposite to the first side, the first direction extends from the first side to the second side, the light-emitting driving signal input terminals comprise a first light-emitting driving signal input terminal and a second light-emitting driving signal input terminal, the first light-emitting driving signal input terminal is disposed close to the first side, and the second light-emitting driving signal input terminal is disposed close to the second side, and the light-emitting elements are light emitting diode (LED) elements.

13. The panel as claimed in claim 12, wherein the light-emitting driving signal input terminals further comprise a third light-emitting driving signal input terminal, and the third light-emitting driving signal input terminal is located between the first light-emitting driving signal input terminal and the second light-emitting driving signal input terminal in the first direction.

14. A panel, comprising a substrate and signal lines and a plurality of light-emitting components disposed on the substrate, wherein the plurality of light-emitting components are distributed along a first direction, each of the light-emitting components is connected to the signal lines, the signal lines comprise at least two signal input terminals, and signals are loaded to the signal lines through the at least two signal input terminals;

wherein each of the light-emitting components comprises a plurality of light bars and constant current driving chips configured to drive the light bars, the signal lines comprise chip driving signal lines, each of the constant current driving chips is electrically connected to the chip driving signal lines, the chip driving signal lines comprise at least two chip driving signal input terminals, and chip driving signals are loaded to the chip driving signal lines through the at least two chip driving signal input terminals, and at least two of the light-emitting components are disposed between the two adjacent chip driving signal input terminals in the first direction.

15. A panel, comprising a substrate and signal lines and a plurality of light-emitting components disposed on the substrate, wherein the plurality of light-emitting components are distributed along a first direction, each of the light-emitting components is connected to the signal lines, the signal lines comprise at least two signal input terminals, and signals are loaded to the signal lines through the at least two signal input terminals;

wherein each of the light-emitting components comprises a plurality of light bars and constant current driving chips configured to drive the light bars, the signal lines are grounding signal lines, each of the constant current driving chips is electrically connected to the grounding signal lines, the grounding signal lines comprise at least two grounding signal input terminals, and grounding signals are loaded to the grounding signal lines through the at least two grounding signal input terminals, and at least two of the light-emitting components are disposed between the two adjacent grounding signal input terminals in the first direction.

* * * * *